US008571723B2

(12) United States Patent
Cooper et al.

(10) Patent No.: US 8,571,723 B2
(45) Date of Patent: Oct. 29, 2013

(54) METHODS AND SYSTEMS FOR ENERGY MANAGEMENT WITHIN A TRANSPORTATION NETWORK

(75) Inventors: Jared Klineman Cooper, Melbourne, FL (US); David Allen Eldredge, Melbourne, FL (US); Mark Bradshaw Kraeling, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/338,954

(22) Filed: Dec. 28, 2011

(65) Prior Publication Data

US 2013/0173083 A1 Jul. 4, 2013

(51) Int. Cl.
*G06F 3/00* (2006.01)

(52) U.S. Cl.
USPC ..... 701/1

(58) Field of Classification Search
USPC ..... 701/1; 705/8; 340/988
See application file for complete search history.

(56) References Cited

U.S. PATENT DOCUMENTS

| | | | | |
|---|---|---|---|---|
| 4,570,217 | A * | 2/1986 | Allen et al. | 700/83 |
| 5,382,948 | A * | 1/1995 | Richmond | 340/5.72 |
| 6,073,088 | A * | 6/2000 | Pryce et al. | 702/182 |
| 6,184,656 | B1 * | 2/2001 | Karunasiri et al. | 320/119 |
| 6,373,380 | B1 * | 4/2002 | Robertson et al. | 340/425.5 |
| 7,395,141 | B1 | 7/2008 | Seck et al. | |
| 7,500,436 | B2 | 3/2009 | Kumar et al. | |
| 7,512,481 | B2 | 3/2009 | Julich et al. | |
| 7,615,966 | B2 * | 11/2009 | Houldsworth et al. | 320/132 |
| 7,618,011 | B2 | 11/2009 | Oleski et al. | |
| 7,663,502 | B2 * | 2/2010 | Breed | 340/12.25 |
| 7,669,534 | B2 | 3/2010 | Kumar et al. | |
| 7,680,750 | B2 | 3/2010 | Daum et al. | |
| 7,715,958 | B2 | 5/2010 | Kumar | |
| 7,715,977 | B2 | 5/2010 | Julich et al. | |
| 7,725,249 | B2 | 5/2010 | Kickbusch et al. | |
| 7,734,383 | B2 | 6/2010 | Philp et al. | |
| 7,797,088 | B2 | 9/2010 | Philp et al. | |
| 7,813,846 | B2 | 10/2010 | Wills et al. | |
| 7,819,003 | B2 * | 10/2010 | Breed et al. | 73/290 V |
| 7,882,789 | B2 | 2/2011 | Kumar et al. | |
| 7,937,193 | B2 | 5/2011 | Philp et al. | |
| 7,974,774 | B2 | 7/2011 | Kumar | |
| 8,025,115 | B2 | 9/2011 | King et al. | |
| 2002/0057212 | A1 * | 5/2002 | Hamilton et al. | 340/988 |

(Continued)

OTHER PUBLICATIONS

Search Report and Written Opinion from corresponding PCT Application No. PCT/US2012/066252 dated Apr. 22, 2013.

(Continued)

*Primary Examiner* — Thomas Tarcza
*Assistant Examiner* — Alex C Dunn
(74) *Attorney, Agent, or Firm* — GE Global Patent Operation; John A. Kramer

(57) ABSTRACT

A method includes determining whether use of an energy management system (EMS) associated with a vehicle traveling in a transportation network is allowed within a region of the transportation network. The EMS obtains a trip plan for the vehicle that designates operational settings of the vehicle as a function of at least one of distance or time along a trip of the vehicle. The method also includes determining whether the EMS is being used by the vehicle when the vehicle is within the region, and sending a message to an off-board location when the EMS is not being used by the vehicle within the region.

41 Claims, 4 Drawing Sheets

(56) References Cited

U.S. PATENT DOCUMENTS

| | | | | |
|---|---|---|---|---|
| 2004/0073468 | A1* | 4/2004 | Vyas et al. | 705/8 |
| 2008/0086240 | A1* | 4/2008 | Breed | 701/1 |
| 2008/0109124 | A1 | 5/2008 | Daum et al. | |
| 2008/0195269 | A1 | 8/2008 | Lacy et al. | |
| 2008/0201027 | A1 | 8/2008 | Julich et al. | |
| 2008/0288132 | A1 | 11/2008 | King et al. | |
| 2009/0037039 | A1 | 2/2009 | Yu et al. | |
| 2009/0099825 | A1 | 4/2009 | Bollapragada et al. | |
| 2009/0118970 | A1 | 5/2009 | Daum et al. | |
| 2009/0132113 | A1 | 5/2009 | Kumar et al. | |
| 2009/0254233 | A1 | 10/2009 | Noffsinger et al. | |
| 2010/0019726 | A1 | 1/2010 | Kumar | |
| 2010/0023190 | A1 | 1/2010 | Kumar et al. | |
| 2010/0043388 | A1 | 2/2010 | Mason et al. | |
| 2010/0150705 | A1 | 6/2010 | Mason et al. | |
| 2010/0153419 | A1 | 6/2010 | Daum et al. | |
| 2010/0163687 | A1 | 7/2010 | Brand et al. | |
| 2010/0185472 | A1 | 7/2010 | Goodermuth et al. | |
| 2010/0241295 | A1 | 9/2010 | Cooper et al. | |
| 2011/0051663 | A1 | 3/2011 | Cooper et al. | |
| 2011/0060486 | A1 | 3/2011 | Meltser et al. | |
| 2011/0099413 | A1 | 4/2011 | Cooper et al. | |
| 2011/0106327 | A1 | 5/2011 | Zhou et al. | |
| 2011/0106328 | A1 | 5/2011 | Zhou et al. | |
| 2011/0112759 | A1* | 5/2011 | Bast et al. | 701/202 |
| 2011/0118899 | A1 | 5/2011 | Brooks et al. | |

OTHER PUBLICATIONS

Sanftleben, D et al., "Verfahren Energiesparende Fahrweise—ESF", ETR Eisenbahntechnische Rundschau, Hestra-Verlag, Darmstadt, DE, vol. 50, No. 9, pp. 510-517, Sep. 1, 2001.

Bitterberg, U, "Wissenbasierte Fahrzeugsteuerungen—Datenbasis Und Potenzielle Anwendungen//Knowledge-Based Train Control Systems—Data Basis and Potential Applications", Zevrail—Glasers Annalen, Georg Siemens Verlag, Berlin, DE, vol. 128, No. 6/07, pp. 240-251, Jun. 1, 2004.

Winter, J., et al., "Fahrerassistenz-System", Signal+ Draht, Telzlaff Verlag GmbH, Darmstadt, DE, vol. 101, No. 10, pp. 6-14, Oct. 1, 2009.

* cited by examiner

METHODS AND SYSTEMS FOR ENERGY MANAGEMENT WITHIN A TRANSPORTATION NETWORK

BACKGROUND

Energy management systems (EMSs) are associated with at least some known vehicles. For example, at least some known vehicles include EMSs on-board the vehicle. The EMS associated with a vehicle uses a trip plan that dictates one or more operations of a propulsion system (e.g., traction motors, brakes) of the vehicle during a trip of the vehicle within a transportation network. The trip plan may be generated using a trip profile that includes information related to the vehicle, the route or surface on which the vehicle travels, the geography over which the route or surface extends, and/or other information. The trip plan can be used to control, for example, the propulsion system of the vehicle to change and/or set the tractive and/or braking efforts of the propulsion system as the vehicle travels over different segments of the trip according to the trip plan.

EMSs are often utilized to control propulsion operations of a vehicle during a trip to increase efficiency (e.g., reduce fuel consumption, reduce emissions, and/or the like) of the vehicle and/or to reduce fatigue of components of the vehicle. But, sometimes an operator of a vehicle may not use EMS along regions of the trip where use of the EMS has been allowed. By not using the EMS along regions where EMS use is allowed, the operator may decrease the efficiency of the vehicle and/or may increase fatigue of components of the vehicle.

BRIEF DESCRIPTION

In one embodiment, a method includes determining whether use of an energy management system (EMS) associated with a vehicle traveling in a transportation network is allowed within a region of the transportation network. The EMS obtains a trip plan for the vehicle that designates operational settings of the vehicle as a function of at least one of distance or time along a trip of the vehicle. The method also includes determining whether the EMS is being used by the vehicle when the vehicle is within the region, and sending a message to an off-board location when the EMS is not being used by the vehicle within the region.

In another embodiment, a method includes receiving a message at an off-board location. The message indicates that an energy management system (EMS) associated with a vehicle traveling along a trip within a transportation network is not being used by the vehicle when the vehicle is within a region of the transportation network. The EMS uses a trip plan of operational settings for the vehicle. The method also includes tracking, at the off-board location, use of the EMS by the vehicle as the vehicle travels along the trip within the transportation network.

In another embodiment, a system includes an energy management system (EMS) associated with a vehicle that is configured to travel in a transportation network. The EMS is configured to use a trip plan of operational settings for the vehicle. The system also includes a control unit for the vehicle. The control unit is configured to control operation of the vehicle and is operatively connected to the EMS. The control unit is configured to determine whether the EMS is available for use by the vehicle, determine whether the EMS is being used by the vehicle, and store information obtained from the determination of whether the EMS is being used by the vehicle.

In another embodiment, a method includes determining whether an energy management system (EMS) associated with a vehicle traveling in a transportation network is available for use by the vehicle. The EMS obtains a trip plan for the vehicle that designates operational settings of the vehicle as a function of at least one of distance or time along a trip of the vehicle. The method also includes determining whether the EMS is being used by the vehicle, and storing information obtained from the determination of whether the EMS is being used by the vehicle.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein provide systems and methods that monitor use of an energy management system (EMS) by a vehicle traveling within a transportation network of a plurality of routes. The methods and systems determine whether an EMS is available for use by the vehicle, which may include determining whether use of an EMS is allowed within a region of the transportation network within which the vehicle is located. Whether the EMS is being used by the vehicle is also determined. The information obtained by determining whether the EMS is available for use and/or whether the EMS is being used may be stored. A message may be sent to a central dispatch office and/or other off-board location associated with the transportation network when the EMS is not being used by the vehicle, for example when the EMS is not being used by the vehicle and the vehicle is within the region. The message may also indicate a reason why the EMS is not being used by the vehicle within the region.

The central dispatch office and/or other off-board location may track use of the EMS by one or more vehicles within the transportation network. For example, the central dispatch office may track use of the EMS by one or more vehicles over one or more trips of each of the one or more vehicles. The tracking information may be used by the central dispatch office in a variety of ways and for a variety of different purposes and end goals. For example, the tracking information may be used to evaluate one or more operators of vehicles within the transportation network, to allot the duties of vehicle operators or other workers, to revise a trip plan of one or more vehicles, and/or the like.

Figure 1:
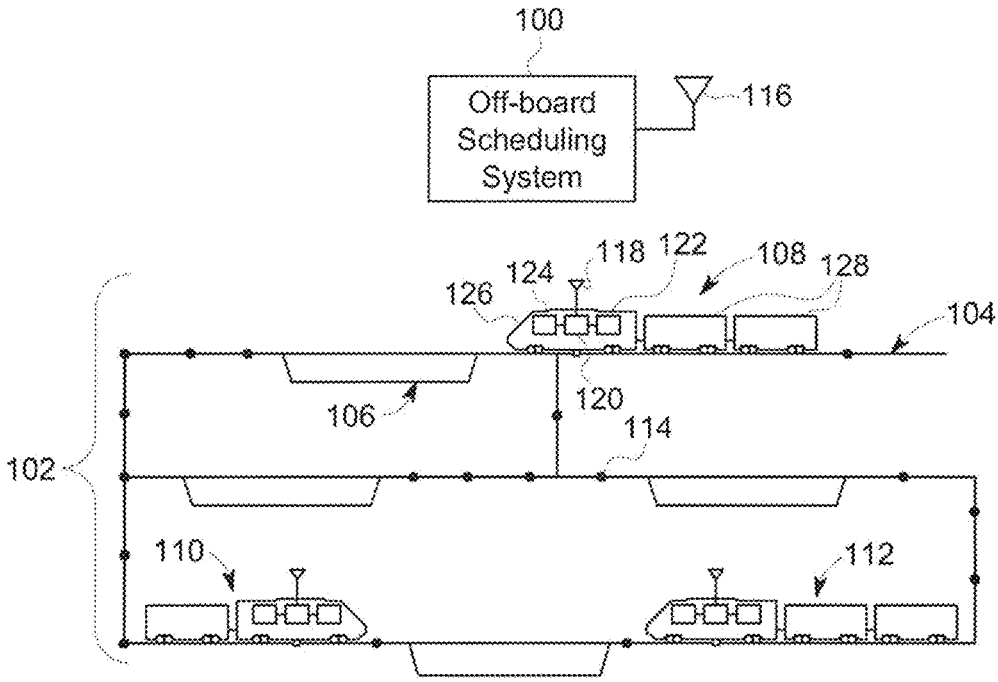
FIG. 1 is a schematic view of one embodiment of an off-board scheduling system and a transportation network.

FIG. 1 is a schematic view of one embodiment of a scheduling system 100 and a transportation network 102. The transportation network 102 includes a plurality of interconnected routes 104, 106. In the illustrated embodiment, the routes 104, 106 represent tracks, such as railroad tracks, that rail vehicles travel across. The routes 104 include main line routes 104 and siding section routes 106. The transportation network 102 may extend over a relatively large area, such as hundreds of square miles or kilometers of land area. The number of routes 104, 106 shown in FIG. 1 is meant to be illustrative and not limiting on embodiments of the described subject matter. Moreover, while one or more embodiments described herein relate to a transportation network formed from rail tracks, not all embodiments are so limited. One or more embodiments may relate to transportation networks having main line routes that cannot be simultaneously traversed in opposite directions by different non-rail vehicles and siding section routes that are connected with the main line routes.

Plural separate vehicles 108, 110, 112 travel along the routes 104, 106. In the illustrated embodiment, the vehicles 108, 110, 112 are shown and described herein as rail vehicles or rail vehicle consists. However, one or more other embodiments may relate to vehicles other than rail vehicles or rail vehicle consists. For example, the vehicles may represent other off-highway vehicles, automobiles (e.g., cars, busses, and the like), marine vessels, airplanes, and the like. A vehicle 108, 110, 112 may include a group of powered vehicles 126 (referring to rail vehicles configured for self propulsion, e.g., locomotives) and/or non-powered vehicles 128 (referring to rail vehicles not configured for self propulsion, e.g., cargo or passenger cars) that are mechanically coupled or linked together to travel along the routes 104, 106. As shown in FIG. 1, the main line routes 104 are interconnected with each other to permit the vehicles 108, 110, 112 to travel over various combinations of the routes 104 to move from a starting location to a destination location. The main line routes 104 may be single track railway lines. For example, each of the main line routes 104 may be shared by vehicles 108, 110, 112 moving in opposite directions. In order to avoid collisions between vehicles 108, 110, 112 traveling in opposite directions toward each other on a common main line route 104 (such as the vehicles 110, 112 in FIG. 1), the siding section route 106 may be connected with the main line route 104.

The siding section route 106 is an auxiliary portion of a route that branches off of the main line route 104. The siding section route 106 may be connected to the main line route 104 and may run parallel to the main line route 104 between two or more locations where the siding section route 106 is coupled with the main line route 104. In one embodiment, the siding section route 106 may be formed from lighter materials or construction such that the siding section route 106 may have lower speed and/or weight limits than the main line route 104. The siding section route 106 may be used by the vehicles 108, 110, 112 to move off of the main line route 104 when another vehicle 108, 110, 112 is approaching. For example, the vehicle 110 may move from the main route 104 to the siding section route 106 when a second rail vehicle 112 approaches along the same main route 104. The vehicle 110 can travel, slow down, and/or stop on the siding section route 106 until the second rail vehicle 112 has passed on the main route 104. Once the second rail vehicle 112 has passed, the first rail vehicle 110 can return to the main route 104.

In one embodiment, the vehicle 108, 110, 112 that moves to the siding section route 106 is referred to as a "yielding vehicle" or a "stopping vehicle," even though the vehicle 108, 110, 112 may not cease all movement on the siding section route 106. The vehicle 108, 110, 112 that passes on the main route 104 while the yielding vehicle 108, 110, 112 is on the siding section route 106 can be referred to as a "passing vehicle." A "meet event" represents a location and/or time at which the passing vehicle 108, 110, 112 and the yielding vehicle 108, 110, 112 meet and pass each other. For example, a meet event can include the geographic location of the siding section route 106 and the time at which the passing vehicle 108, 110, 112 passes the geographic location of the siding section route 106.

The vehicles 108, 110, 112 travel along the routes 104, 106 according to a movement plan of the transportation network 102. The movement plan is a logical construct of the movement of the vehicles 108, 110, 112 moving through the transportation network 102. For example, the movement plane may include a schedule for each of the vehicles 108, 110, 112, with the schedules directing the vehicles 108, 110, 112 to move along the routes 104, 106 at associated times. In one embodiment, the movement plan includes a list, table, or other logical arrangement of geographic locations (e.g., global positioning system coordinates) within the transportation network 102 and associated times. The vehicles 108, 110, 112 move along various paths within the transportation network 102 to arrive at the geographic locations associated with the schedule of each vehicle 108, 110, 112 at the specified times. The locations in the movement plan can be referred to as "scheduled waypoints" and the times at which the vehicles 108, 110, 112 are scheduled to arrive or pass the scheduled waypoints can be referred to as "scheduled times."

The movement plan can be based on starting locations and destination locations of the vehicles 108, 110, 112. For example, a schedule may be developed for each vehicle 108, 110, 112 that directs the vehicle 108, 110, 112 where and when to move within the transportation network 102 to arrive at a specified destination from the starting location of the vehicle 108, 110, 112. The schedules may include several scheduled waypoints located between the starting location and the destination location of the vehicle 108, 110, 112, along with scheduled times for the scheduled waypoints. For example, a schedule may include several waypoints 114 located along a route between the starting location and the destination location of a vehicle 108, 110, 112.

The movement plan may be determined by the scheduling system 100. As shown in FIG. 1, the scheduling system 100 can be disposed off-board (e.g., outside) of the vehicles 108, 110, 112. For example, the scheduling system 100 may be disposed at a central dispatch office for a railroad company. The scheduling system 100 communicates the schedules of the vehicles 108, 110, 112. The scheduling system 100 can include a wireless antenna 116 (and associated transceiving equipment), such as a radio frequency (RF) or cellular antenna, that wirelessly transmits the schedules to the vehicles 108, 110, 112. For example, the scheduling system 100 may transmit a different list of waypoints 114 and associated scheduled times to each of the vehicles 108, 110, 112.

The vehicles 108, 110, 112 include wireless antennas 118, such as RF or cellular antennas, that receive the schedules from the scheduling system 100. The wireless antenna 118 communicates the received schedule to an energy management system (EMS) 120 disposed on-board the vehicle 108, 110, 112. The EMS 120 may be embodied in a computer, computer processor, microcontroller, microprocessor, or other logic-based device, that operates based on one or more sets of instructions (e.g., software) stored on a tangible and non-transitory computer readable storage medium (e.g., hard drive, flash drive, ROM, or RAM). The EMS 120 may include a location determining device, such as a global positioning system (GPS) device, that identifies a current location of the vehicle 108, 110, 112 and a timing device, such as a clock, that determines a current time of the vehicle 108, 110, 112. The EMS 120 can compare the current location and time of the vehicle 108, 110, 112 to the received schedule to determine if the vehicle 108, 110, 112 is ahead of schedule (e.g., is arriving at a scheduled waypoint 114 before an associated scheduled time), behind schedule (e.g., is arriving at a scheduled waypoint 114 after an associated scheduled time), or on time (e.g., is arriving at a scheduled waypoint 114 at a scheduled time or within a predetermined time period of the associated scheduled time).

Based on the comparison between the current location and time of the vehicle 108, 110, 112 and the received schedule, the EMS 120 may generate control instructions that direct operation of a propulsion subsystem 122 of the respective vehicle 108, 110, 112. The propulsion subsystem 122 can include one or more traction motors, brakes, and the like, that provide tractive effort to propel the vehicle 108, 110, 112 along the routes 104, 106 and provide braking efforts to slow or stop movement of the vehicle 108, 110, 112. The control instructions may include commands that direct an operator of the vehicle 108, 110, 112 to change or set the tractive effort and/or braking effort supplied by the propulsion subsystem 122 of the vehicle 108, 110, 112, or commands that automatically change or set the tractive effort and/or braking effort. For example, if the vehicle 108, 110, 112 is behind schedule, the control instructions may reduce braking effort and/or increase tractive effort. If the vehicle 108, 110, 112 is ahead of schedule, the control instructions may increase braking effort and/or reduce tractive effort.

In the illustrated embodiment, the EMS 120 determines a trip plan that dictates one or more operations of the propulsion subsystem 122 during a trip of the corresponding vehicle 108, 110, 112. A trip of the vehicle 108, 110, 112 includes the travel of the vehicle 108, 110, 112 from a starting location to a destination location. The EMS 120 can refer to a trip profile that includes information related to the vehicle 108, 110, 112, the route or surface on which the vehicle 108, 110, 112 travels, the geography over which the route or surface extends, and other information in order to form the trip plan. The trip plan can be used to control the propulsion subsystems of different powered rail vehicles in the vehicle 108, 110, or 112 to change the tractive efforts of the propulsion subsystems as the vehicle 108, 110, 112 travels over different segments of the trip according to the trip plan.

For example, if the trip profile requires the vehicle 108, 110, or 112 to traverse a steep incline and the trip profile indicates that the vehicle 108, 110, or 112 is carrying significantly heavy cargo, then the EMS 120 may form a trip plan that directs one or more of the powered rail vehicles of the vehicle 108, 110, or 112 to increase the tractive efforts supplied by the respective propulsion subsystems. Conversely, if the vehicle 108, 110, or 112 is carrying a smaller cargo load based on the trip profile, then the EMS 120 may form a trip plan that directs the propulsion subsystems to increase the supplied tractive efforts by a smaller amount than the tractive efforts would otherwise be increased if the data indicated a heavier cargo load. The trip plan may be formed according to other factors, such as changes in the route that the vehicle 108, 110, or 112 travels along, regulatory requirements (e.g., emission limits) of the regions through which the vehicle 108, 110, or 112 travels, and the like, and based on the trip profile. In one embodiment, the EMS 120 includes a software application such as the Trip Optimizer™ system provided by General Electric Company, to control propulsion operations of the vehicle 108, 110, or 112 during the trip in order to reduce fuel consumption of the powered rail vehicles, reduce emissions generated, and/or to reduce wear and tear on the vehicle 108, 110, 112.

The trip data used to form the trip profile may include vehicle (e.g., train) data, route data, and/or an update to trip data, vehicle data, or route data. Vehicle (e.g., train) data includes information about the vehicle and/or cargo being carried by the vehicle. For example, vehicle data may represent cargo content (such as information representative of cargo being transported by the vehicle) and/or vehicle information (such as model numbers, manufacturers, horsepower, and the like, of locomotives and/or other railcars in the vehicle). Route data may include information about an upcoming trip by the vehicle. By way of example, route data may include a trip profile of an upcoming trip of the vehicle (e.g., information that can be used to control one or more operations of the vehicle, such as tractive and/or braking efforts provided during the powered units of a vehicle during an upcoming trip), station information (such as the location of a beginning station where the upcoming trip is to begin and/or the location of an ending station where the upcoming trip is to end), restriction information (such as work zone identifications, or information on locations where the route is being repaired or is near another route being repaired and corresponding speed/throttle limitations on the vehicle), and/or operating mode information (such as speed/throttle limitations on the vehicle in various locations, slow orders, and the like). Route data can include information about the route or rails upon which the vehicle travels. For example, the route data can include information about locations of damaged sections of a route, locations of route sections that are under repair or construction, the curvature and/or grade of a route, GPS coordinates of the route, and the like. The route data is related to operations of the vehicle as the route data includes information about the route that the vehicle is or will be traveling on. However, other types of data can be recorded as the data and/or the data may be used for other operations. The term "data" may refer to trip data, vehicle (e.g., train) data, and route data, only one of trip data, vehicle data, or route data, or another type of data.

In one embodiment, the vehicle 108, 110, 112 includes a display device 124 that visually presents the control instructions to the operator on-board the vehicle 108, 110, 112. For example, a computer monitor or display screen may present textual settings for a throttle or brake setting of the propulsion subsystem 122. The textual settings prompt the operator to change the tractive effort and/or braking effort of the propulsion subsystem 122. Alternatively, the control instructions may be communicated to the propulsion subsystem 122 to automatically control the tractive effort and/or braking effort of the propulsion subsystem 122. For example, the propulsion subsystem 122 may receive an updated throttle or brake setting from the EMS 120 and modify the tractive effort or braking effort in response thereto.

Figure 2:
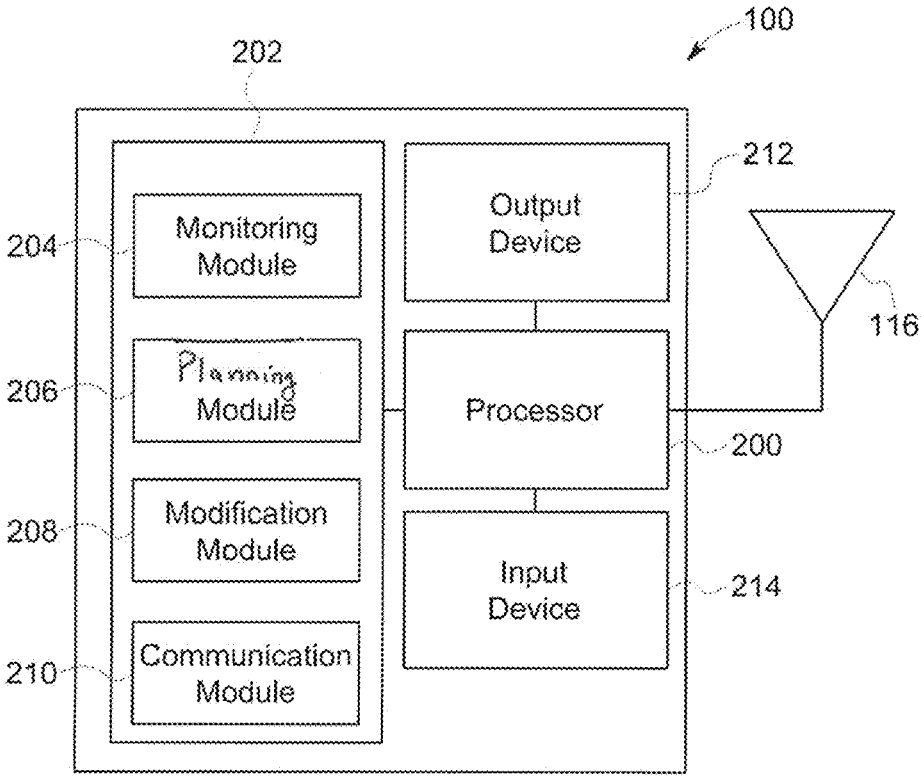
FIG. 2 is a schematic diagram of one embodiment of the off-board scheduling system shown in FIG. 1.

FIG. 2 is a schematic diagram of one embodiment of the off-board scheduling system 100. The scheduling system 100 includes a processor 200 (e.g., a computer processor, microprocessor, controller, microcontroller, or other logic-based computer device) that is communicatively coupled with a tangible and non-transitory computer readable storage medium 202, such as a computer hard drive, flash drive, RAM, ROM, EEPROM, and the like. The storage medium 202 includes one or more sets of instructions that direct the processor 200 to perform various operations or steps. For example, the storage medium 202 can include software applications. In the illustrated embodiment, the sets of instructions are shown as a monitoring module 204, a planning module 206, a modification module 208, and a communication module 210. Alternatively, one or more of the monitoring module 204, the planning module 206, the modification module 208, and/or the communication module 210 may be embodied in a processor similar to the processor 200. For example, one or more of the modules 204, 206, 208, 210 may each be a dedicated processor or application specific integrated circuit (ASIC).

An output device 212 is communicatively coupled with the processor 200. The output device 212 presents information to an operator of the scheduling system 100, such as schedules of vehicles 108, 110, 112 (shown in FIG. 1), adherence of the vehicles 108, 110, 112 to the schedules, throughput parameters (described below) of the transportation network 102 (shown in FIG. 1), and the like. By way of example, the output device 212 may include a computer monitor, touchscreen, a printer, a speaker, and the like. An input device 214 is communicatively coupled with the processor 200. The input device 214 receives information from the operator and communicates the information to the processor 200. The operator may control operation of the scheduling system 100 using the input device 214. By way of example, the input device 214 may include a keyboard, electronic mouse device, stylus, touchscreen, microphone, and the like.

The monitoring module 204 monitors the vehicles 108, 110, 112 (shown in FIG. 1) as the vehicles 108, 110, 112 travel through the transportation network 102 (shown in FIG. 1). The monitoring module 204 can track locations of the vehicles 108, 110, 112. For example, each of the vehicles 108, 110, 112 may periodically transmit the actual locations and/or times at which the actual locations are determined to the antenna 116 of the scheduling system 100. The actual locations and times of the vehicles 108, 110, 112 can be conveyed to the monitoring module 204 so that the monitoring module 204 can determine where the various vehicles 108, 110, 112 are located within the transportation network 102.

In one embodiment, the planning module 206 determines the trip plans for the vehicles 108, 110, 112. For example, the planning module 206 can receive a trip profile and generate a trip plan of operational settings (e.g., throttle settings, brake settings, speeds, power output, and/or the like) for the vehicle as expressed as a function of time and/or distance along a trip. The vehicle can use the trip plan to set, control, and/or recommend actual operational settings of the vehicle. Different trip plans for different vehicles and/or different trips can be created. A combination of the trip plans and/or a schedule of the vehicle may be referred to herein as a movement plan of the transportation network.

As the vehicles 108, 110, 112 (shown in FIG. 1) travel in the transportation network 102 (shown in FIG. 1), one or more vehicles 108, 110, 112 may deviate from the movement plan by moving ahead or behind in the associated schedules. For example, adverse weather conditions, degraded health of the vehicles, breakdowns, and/or the like may cause one or more vehicles to fall behind schedule. The modification module 208 can change the trip plan for one or more of the vehicles. For example, if a vehicle is too far behind schedule, the modification module 208 can adjust the trip plan of the vehicle or create a new trip plan for the vehicle.

Figure 3:
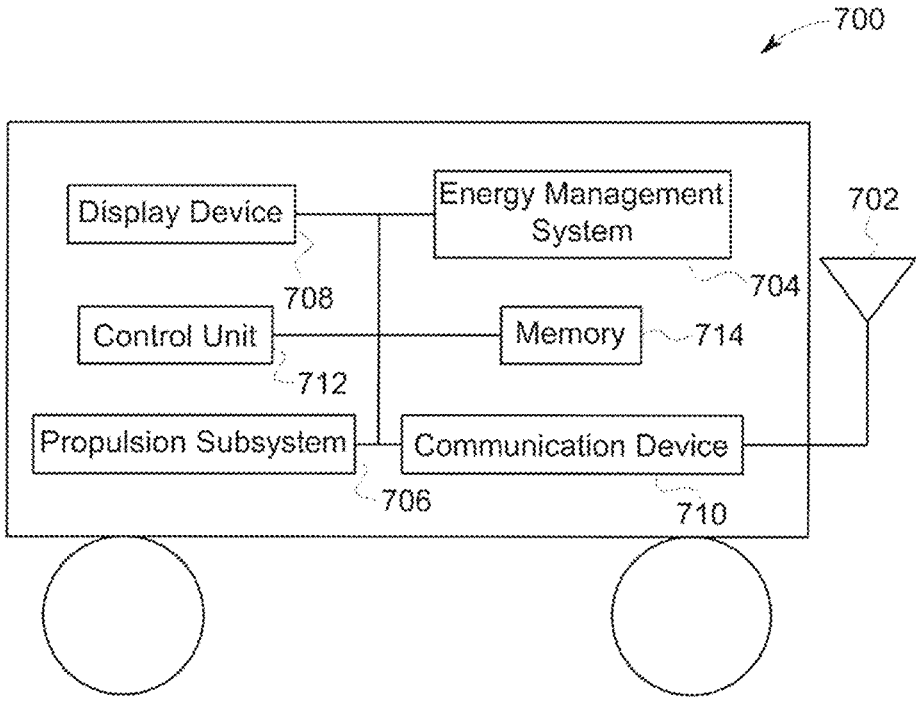
FIG. 3 is a schematic illustration of a powered rail vehicle in accordance with one embodiment.

FIG. 3 is a schematic illustration of a powered rail vehicle 700 in accordance with one embodiment. The powered rail vehicle 700 may represent one or more of the powered rail vehicles 126 (shown in FIG. 1) of the vehicles 108, 110, 112 (shown in FIG. 1). The powered rail vehicle 700 includes an antenna 702 that may be similar to the antenna 118 (shown in FIG. 1), an energy management system (EMS) 704 that may be similar to the EMS 120 (shown in FIG. 1), a propulsion subsystem 706 that may be similar to the propulsion subsystem 122 (shown in FIG. 1), and a display device 708 that may be similar to the display device 124 (shown in FIG. 1).

In the illustrated embodiment, the powered rail vehicle 700 includes a communication device 710 that is communicatively coupled with the antenna 702 for communicating data with off-board components. For example, the communication device 710 can include a transceiver device that wirelessly transmits and receives data messages, such as updated meet events from the scheduling system 100 (shown in FIG. 1). The communication device 710 conveys the data to one or more of the display device 708 for presentation of the data to the operator of the powered rail vehicle 700, to the EMS 704 for use in determining tractive efforts and/or braking efforts to be provided by the powered rail vehicle 700, to a computer readable storage medium ("memory 714") of the powered rail vehicle 700, and/or to a control unit 712 of the powered rail vehicle 700.

The memory 714 may include a tangible and non-transitory computer readable storage medium, such as a computer hard drive, flash drive, RAM, ROM, EEPROM, and the like. The memory 714 can include one or more sets of instructions that direct the control unit 712 to perform various operations or steps. For example, the memory 714 can include software applications.

The control unit 712 may represent a hardware and/or software system that operates to perform one or more functions to control operations of the powered rail vehicle 700. For example, the control unit 712 may include one or more computer processors, controllers, or other logic-based devices that perform operations based on instructions stored on a tangible and non-transitory computer readable storage medium, such as the memory 714, for controlling tractive efforts and/or braking efforts of the powered rail vehicle 700. Alternatively, the control unit 712 may include a hard-wired device that performs operations based on hard-wired logic of the device. The control unit 712 shown in FIG. 3 may represent the hardware that operates based on software or hard-wired instructions, the software that directs hardware to perform the operations, or a combination thereof.

The control unit 712 can receive data messages from the scheduling system 100 (shown in FIG. 1) via the communication device 710 and use information included in the data messages to control or change tractive efforts and/or braking efforts of the powered rail vehicle 700 based on the information. For example, the control unit 712 may receive trip plans and/or updated trip plans from the scheduling system 100.

In one embodiment, the scheduling system 100 sends a scheduled destination and/or a scheduled arrival time to the EMS 704, and the EMS 704 generates the trip plan for the vehicle based on the information received from the scheduling system 100. The EMS 704 conveys the trip plan that is formed for a vehicle that includes the powered rail vehicle 700 to the control unit 712. As described above, the trip plan may be formed based on a trip profile for the vehicle and may dictate tractive efforts and/or braking efforts for different portions of the trip. The EMS 704 may update the trip plan when an updated schedule information is received from the scheduling system 100 (shown in FIG. 1). For example, if an updated destination and/or updated arrival time is received from the scheduling system 100, then the EMS 704 may revise the trip plan to require lower speed and/or tractive efforts from the powered rail vehicles in the vehicle to arrive at a later time for the updated event than the original time and/or to arrive at a closer location for the updated meet event than the original location.

The trip plan may include control instructions for controlling (e.g., setting, maintaining, changing, and/or the like) the tractive effort and/or braking effort of the propulsion subsystem 706. The control unit 712 can receive the trip plan from the EMS 704 and automatically control the tractive effort and/or braking effort of the propulsion subsystem 706 accordingly using the control instructions of the trip plan. For example, if the updated trip plan dictates that a lower speed is to be used to arrive at the updated meet event, then the control unit 712 can direct the propulsion subsystem 706 to reduce the tractive effort provided by the propulsion subsystem 706. Alternatively, the control unit 712 uses the control instructions provided within the trip plan to indicate (e.g., using a display, audible indications, and/or the like) control commands that direct an operator of the vehicle 700 to control the tractive effort and/or braking effort supplied by the propulsion subsystem 706.

Figure 4:
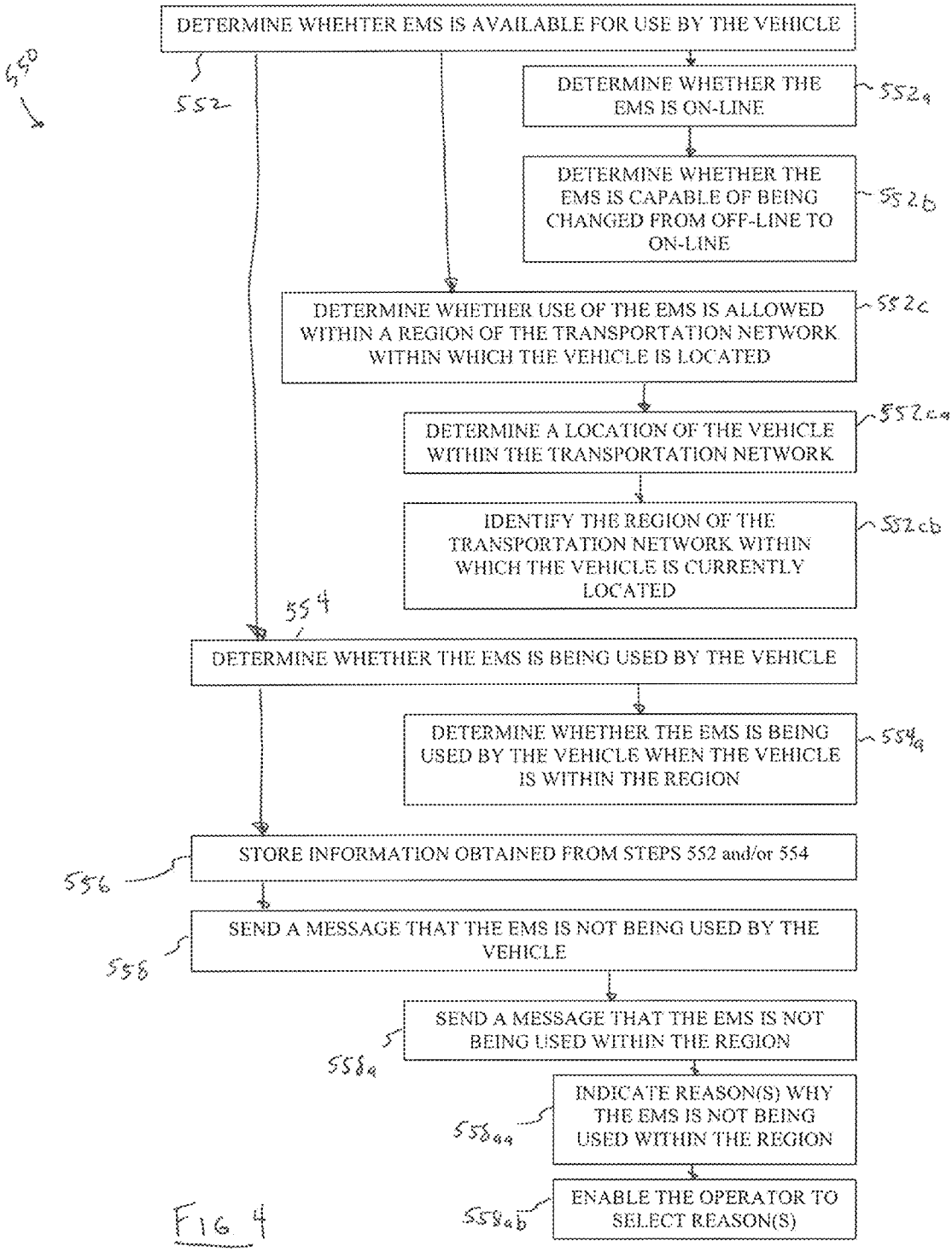
FIG. 4 is a flowchart of one embodiment of a method for monitoring use of an energy management system (EMS) by a vehicle traveling within a transportation network.

FIG. 4 is flowchart of one embodiment of a method 550 for monitoring use of an EMS by a vehicle traveling within a transportation network. The method 550 may be preformed by a system including a control unit, an EMS, and/or an off-board location (e.g., the central dispatch office of the transportation network). For example, the method 550 may be preformed by a system that includes the control unit 712 (FIG. 3), the EMS 120 (FIG. 1) and/or the EMS 704 (FIG. 3), and/or the central dispatch office associated with the transportation network 102 (FIG. 1). The central dispatch office may include a facility where the scheduling system 100 is located, or may be another facility that is remote from (e.g., off-board) the vehicle. Although the method 550 is described herein with respect to the central dispatch office, it should be understood that any other off-board location may be used. The method 550 may be used to monitor use of an EMS by a vehicle within the transportation network. For example, the method 550 may be used to monitor use of the EMS 120 of at least one of the vehicles 108, 110, 112 (FIG. 1) and/or the EMS 704 of the vehicle 700 (FIG. 3). For exemplary purposes only, the method 550 will be described herein with reference to the vehicle 700 traveling within the transportation network 102. Although the EMS 704 is shown as being located on-board the vehicle 700, the EMS 704 may be additionally or alternatively located at the central dispatch office and/or another location off-board the vehicle 700.

At 552, the method 550 includes determining whether the EMS 704 is available for use by the vehicle 700. By "available for use", it is meant that the EMS 704 is capable of being used by the vehicle 700. For example, the EMS 704 may be capable of being used by the vehicle 700 when the EMS 704 is on-line (e.g., in a powered, or on, state). Optionally, the determining step 552 includes determining at 552*a* whether the EMS 704 is on-line. Moreover, and for example, the EMS 704 may be capable of being used by the vehicle 700 when the EMS 704 is off-line (e.g., in an unpowered, or off, state) but is capable of being changed to be on-line. The determining step 552 optionally includes determining at 552*b* whether the EMS 704 is capable of being changed from being off-line to being on-line. The method 550 may include indicating to the vehicle operator on a display (e.g., the display device 708) that the EMS 704 is currently off-line but is currently capable of being changed from being off-line to being on-line. In addition or alternative to such an indication, the method 550 may include prompting the vehicle operator to change the EMS 704 from being off-line to being on-line, for example by displaying text and/or another graphic, using an audible prompt, and/or the like.

Optionally, the determining step 552 includes determining, at 552*c*, whether use of the EMS 704 of the vehicle 700 is allowed within a region of the transportation network 102 within which the vehicle 700 is located. The region may be any region within the transportation network 102 and includes a segment of a trip (e.g., a segment of a movement plan) of the vehicle 700 within the transportation network 102. Determining at 552*c* whether use of the EMS 704 is allowed within a particular region may include first determining at 552*ca* a location of the vehicle 700 within the transportation network 102. The determining step 552*c* may further include identifying at 552*cb* the region of the transportation network 102 within which the vehicle 700 is currently located. The determination at 552*c* as to whether use of the EMS 704 is allowed within a particular region may be performed upon entrance of the vehicle 700 into the region or a predetermined amount of time after the vehicle 700 has entered the region. In one embodiment, the system is prompted to determine at 552*c* whether use of the EMS 704 is allowed within the region upon movement of the vehicle 700 out of a region within which use of the EMS 704 is prohibited (i.e., not allowed).

The determination at 552*c* of whether use of the EMS 704 is allowed within the region may be performed using any method, information, comparison, and/or the like. For example, determining at 552*c* may include comparing the location (e.g., the approximate exact location of the vehicle 700 within the transportation network 102, the region within which the vehicle 700 is located, and/or the location of the vehicle 700 within the region) of the vehicle 700 within the transportation network 102 to a route chart of the EMS 704 to determine whether the region is a region within which use of the EMS is currently allowed. Regions within which use of the EMS 704 is allowed may be identified within the route chart as "energy management regions".

Use of the EMS 704 within a particular region may be prohibited for a variety of reasons, such as, but not limited to, ambient weather conditions within the region, the orientation, structure, path, and/or the like of the route (e.g., the routes 104, 106), a configuration issue with the EMS 704, and/or the like. For example, use of the EMS 704 during some ambient weather conditions may cause unsafe operation of the vehicle 700. In other words, and for example, some ambient conditions may require that the operator manually (e.g., without following any control commands) control operation of the vehicle 700 to prevent the loss or reduction of control of the vehicle. Moreover, and for example, the EMS 704 may have a configuration issue that prevents proper operation of the EMS 704 and/or prevents adequate control of the vehicle 700. Configuration issues include, but are not limited to, a malfunction or other fault of the EMS 704, one or more over speeds and/or under speeds, an out of date software version of the EMS 704, and/or the like. Another example of a configuration issue of the EMS 704 is an EMS that is not configured to control the brakes of the vehicle 700, wherein use of the EMS 704 may not be allowed in regions that have downwardly sloped grades. The orientation, structure, path, and/or the like of the route (e.g., a grade, turning radius, and/or the like) within a region may cause unsafe operation of the vehicle 700 when the EMS 704 is used. Such regions may be referred to as "yellow zones" or "manual control zones", wherein the operator manually controls operation of the vehicle 700.

The determination at 552*c* may be included within the method 550 in addition or alternatively to the steps 552*a* and/or 552*b*. In one embodiment, the control unit 712 is configured to perform some or all of the determining step 552 (including some or all of the steps 552*a*, 552*b*, 552*c*, 552*ca*, and/or 552*cb*). But, one or more other components may be provided in addition or alternative to the control unit 712 for performing some or all of the determining step 552 (including some or all of the steps 552*a*, 552*b*, 552*c*, 552*ca*, and/or 552*cb*). In one embodiment, one or more of the component(s) used to perform some or all of the determining step 552

(including some or all of the steps 552*a*, 552*b*, 552*c*, 552*ca*, and/or 552*cb*) is located off-board the vehicle 700.

If it is determined at 552 that the EMS 704 is available for use by the vehicle 700, the method 550 includes, at 554, determining whether the EMS 704 is being used by the vehicle 700. For example, if it is determined at 552*c* that use of the EMS 704 is allowed within the region, the determination at 554 may include determining, at 554*a*, whether the EMS 704 is being used by the vehicle 700 when the vehicle 700 is within the region. As used herein, the EMS 704 is being "used by the vehicle" when: the trip plan of the EMS 704 is used to automatically control the propulsion subsystem 706 of the vehicle 700; or when an operator of the vehicle 700 is following one or more control commands within a predetermined threshold.

The determination at 554*a* may be made using any method, information, comparison, and/or the like. For example, in one embodiment, determining 554 whether the EMS 704 is being used by the vehicle 700 includes determining whether a trip plan of the EMS 704 is being followed by the vehicle 700. Moreover, and for example, determining 554 whether the EMS 704 is being used by the vehicle 700 may include determining whether an operator of the vehicle 700 is following one or more control commands within a predetermined threshold.

In one embodiment, the control unit 712 is configured to perform some or all of the determining step 554 (including some or all of the step 554*a*). But, one or more other components may be provided in addition or alternative to the control unit 712 for performing some or all of the determining step 554 (including some or all of the step 554*a*). In one embodiment, one or more of the component(s) used to perform some or all of the determining step 554 (including some or all of the step 554*a*) is located off-board the vehicle 700.

The method 550 optionally includes storing, at 556, the information obtained from the determination steps 552 and/or 554. For example, storing at 556 may include storing the results of the determination step 552 (e.g., storing whether the EMS 704 was available for use by the vehicle 700 at one or more specific times and/or within one or more time periods). Moreover, and for example, the storing step 556 may include storing the results of the determination step 554, which may include, for example, storing whether the EMS 704 was being used by the vehicle 700 at one or more specific times and/or within one or more time periods when the EMS 704 was available for use by the vehicle 700. Storing the results of the determination step 554 may additionally or alternatively include storing the results of the determination step 554*a* (e.g., storing whether the EMS 704 was being used by the vehicle 700 when the vehicle 700 was within one or more regions wherein use of the EMS 704 was allowed).

Some or all of the information stored at 556 may be stored on-board the vehicle 700 (e.g., in the memory 714), and/or some or all of the information stored at 556 may be stored off-board the vehicle 700 (e.g., at the central dispatch office and/or other off-board location). The information stored at 556 may be used by the vehicle 700, the central dispatch office and/or other off-board location, and/or one or more other components in a variety of ways and for a variety of different purposes and end goals, such as, but not limited to, evaluating one or more operators of vehicles 700 within the transportation network 102, allotting the duties of vehicle operators or other workers, revising a trip plan of one or more vehicles 700, and/or the like. The information stored at 556 may be used to increase an efficiency (e.g., reduce fuel consumption) of the transportation network 102, for example of one or more trips of one or more vehicles 700. The information stored at 556 may be used to reduce the emissions generated by vehicles 700 and/or to reduce the amount of fatigue experienced by components of vehicles 700 (e.g., to provide components of a vehicle 700 with a longer life span).

The method 550 optionally includes sending, at 558, a message to the central dispatch office and/or other off-board location that the EMS 704 is not being used by the vehicle 700 when the EMS 704 is available for use by the vehicle 700. For example, if it is determined at 554*a* that the EMS 704 is not being used by the vehicle 700 within a region within which use of the EMS 704 is allowed, sending a message at 558 may include sending, at 558*a*, a message to the central dispatch office and/or other off-board location that the EMS 704 is not being used by the vehicle 700 within the region.

A message may be sent at 558 at any point(s) in time when the EMS 704 is available for use by the vehicle 700 but is not being used by the vehicle 700. For example, a message may be sent at 558*a* upon entry of the vehicle 700 into the region (within which use of the EMS 704 is allowed) and completion of the determining steps 552 and 554. But, the message sent at 558 (including any message sent at 558*a*) may alternatively be sent with a delay. For example, sending the message sent at 558 may include waiting a predetermined amount of time after it has been determined at 554 that the EMS 704 is not being used but is available to send at 558 the message. Moreover, and for example, sending the message at 558*a* may include waiting a predetermined amount of time after the vehicle 700 has entered the region to send at 558*a* the message. The delay may give an operator the chance to initiate use of the EMS 704 once the operator realizes that the EMS 704 is available for use. For example, the delay may give an operator the chance to initiate use the EMS 704 after the vehicle 700 has entered the region and once the operator realizes that use of the EMS within the region is allowed. The message sent at 558*a* may indicate to the central dispatch office and/or other off-board location that the EMS 704 is allowed for use within the region that the vehicle 700 is within.

Whether in response to the determination step 554*a* and/or the sending step 558*a*, the method 550 may include indicating to a vehicle operator on a display (e.g., the display device 708) that the EMS 704 is not currently being used but is allowed for use within the region that vehicle 700 is traveling within. The method 550 may additionally or alternatively include prompting the vehicle operator to initiate use of the EMS 704 when the EMS 704 is allowed for use but is not currently being used. For example, the display may prompt the vehicle operator by displaying text or another graphic. In addition or alternatively, the prompt may be an audible prompt output by the display and/or another device.

Optionally, sending the message at 558*a* may include indicating at 558*aa* one or more reasons why the EMS 704 is not being used by the vehicle 700 within the region. The indication at 558*aa* may be within the message that the EMS 704 is not being used by the vehicle 700 within the region, or may be contained within another message sent to the central dispatch office and/or other off-board location. The reason(s) may be any reason, such as, but not limited to, the region is a yellow or manual control region, ambient weather conditions within the region, the orientation, structure, path, and/or the like of the route (e.g., the routes 104, 106), a configuration issue with the EMS 704, an operator selection, and/or the like.

In one embodiment, the method 550 includes enabling at 558*ab* the operator of the vehicle 700 to select one or more reasons why the EMS 704 is not being used within the region. For example, the display may display a list of one or more reasons that the operator can select using the display (e.g., a touch screen) and/or an input device (e.g., a mouse, a keyboard, a pointer, and/or the like). In addition or alternatively, the operator may use the display and/or an input device to compose one or more reasons. The reason(s) selected or composed by the operator may be any reason, such as, but not limited to, the region is a yellow or manual control region, ambient weather conditions within the region, the orientation, structure, path, and/or the like of the route (e.g., the routes 104, 106), a configuration issue with the EMS 704, and/or the like. For example, in some situations the central dispatch office and/or other off-board location may not know that a region is a yellow or manual control zone, in which case the operator may select such a reason for not using the EMS 704. Moreover, and for example, even in regions within which use of the EMS 704 is allowed by the central dispatch office and/or other off-board location, the operator may feel that the ambient weather conditions and/or the orientation, structure, path, and/or the like of the route within the region will result in unsafe operation of the vehicle 700 using the EMS 704. In such situations, the operator may desire to manually control operation of the vehicle instead of using the EMS 704.

In one embodiment, the control unit 712 is configured to perform some or all of the sending step 558 (including some or all of the steps 558*a*, 558*aa*, and/or 558*ab*). But, one or more other components may be provided in addition or alternative to the control unit 712 for performing the some or all of the sending step 558 (including some or all of the steps 558*a*, 558*aa*, and/or 558*ab*. In one embodiment, the component(s) used to perform some or all of the sending step 558 (including some or all of the steps 558*a*, 558*aa*, and/or 558*ab*) is located off-board the vehicle 700.

Figure 5:
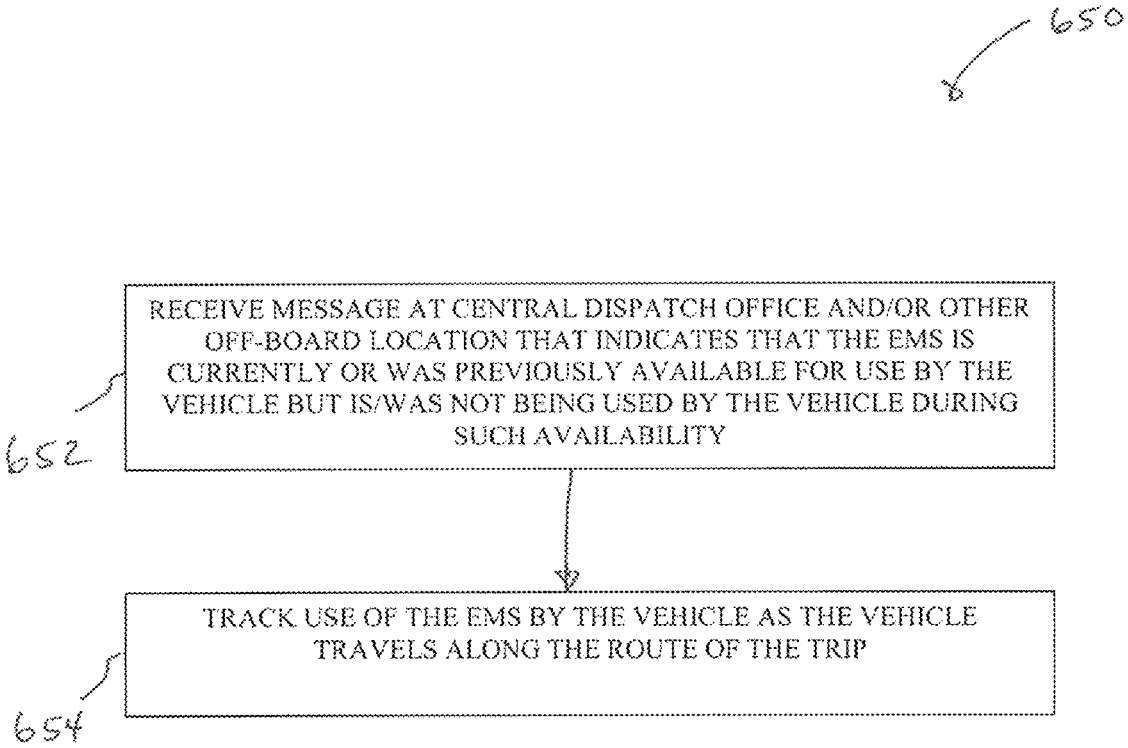
FIG. 5 is a flowchart of one embodiment of another method for monitoring use of an EMS by a vehicle traveling within a transportation network.

As briefly described above, the central dispatch office and/or other off-board location may track use of an EMS by one or more vehicles within a transportation network. FIG. 5 is flowchart of one embodiment of another method 650 for monitoring use of an EMS by a vehicle traveling within a transportation network. The method 650 may be preformed by a system including a control unit, an EMS, and/or an off-board location (e.g., the central dispatch office of the transportation network). For example, the method 650 may be preformed by a system that includes the control unit 712 (FIG. 3), the EMS 120 (FIG. 1) and/or the EMS 704 (FIG. 3), and/or the central dispatch office associated with the transportation network 102 (FIG. 1). Although the method 650 is described herein with respect to the central dispatch office, it should be understood that any other off-board location may be used. The method 650 may be used to monitor use of an EMS by any vehicle within any transportation network. For example, the method 650 may be used to monitor use of the EMS 120 of at least one of the vehicles 108, 110, 112 (FIG. 1) and/or the EMS 704 of the vehicle 700 (FIG. 3). For exemplary purposes only, the method 650 will be described herein with reference to the vehicle 700 traveling within the transportation network 102.

At 652, the method 650 includes receiving a message at a central dispatch office and/or other off-board location associated with the transportation network 102. The message received at 652 indicates that the EMS 704 of the vehicle 700, which is or was traveling along a trip within the transportation network 102, is currently or was previously available for use by the vehicle 700 but is/was not being used by the vehicle 700 during such availability. For example, the message received at 652 may indicate that the EMS 704 of the vehicle is not being used by the vehicle 700 when the vehicle 700 is within a region of the transportation network 102 within which use of the EMS 704 is allowed. Moreover, and for example, the message received at 652 may indicate that the EMS 704 of the vehicle was not being used by the vehicle 700 when the vehicle 700 was within a region within which use of the EMS 704 is allowed. The message may be received at 652 from the vehicle 700, for example as described above with respect to the method 550 (FIG. 4). The message received at 652 may indicate that the EMS 704 is allowed to be used within a region within which the vehicle 700 was or is currently traveling. At 654, the method 650 further includes tracking, for example at the central dispatch office and/or other off-board location, use of the EMS 704 by the vehicle 700 as the vehicle 700 travels within the transportation network 102 along the route of the trip. In one alternative embodiment, the receiving and/or tracking steps 652 and 654, respectively, are preformed on-board one or more vehicles 700 in addition or alternative to being performed at the central dispatch office and/or other off-board location.

The tracking performed at step 654 generates tracking information related to use of the EMS 704 by one or more vehicles 700 during one or more trips of the vehicle(s) 700 within the transportation network 102. The tracking information generated may be for a single trip of a single vehicle 700. Alternatively, the tracking information generated may be for a plurality of trips of a single vehicle 700, or may be for a plurality of vehicles (each having at least one trip). Accordingly, the receiving step 652 may include receiving one or more messages for a single trip of a single vehicle 700, may include receiving one or more messages for each of a plurality of trips of a single vehicle 700, or may include receiving one or more messages for at least one trip of a plurality of vehicles 700.

The tracking information may be used by the central dispatch office and/or one or more other components in a variety of ways and for a variety of different purposes and end goals, such as, but not limited to, evaluating one or more operators of vehicles 700 within the transportation network 102, allotting the duties of vehicle operators or other workers, revising a trip plan of one or more vehicles 700, and/or the like. The tracking information may be used to increase an efficiency (e.g., reduce fuel consumption) of the transportation network 102, for example of one or more trips of one or more vehicles 700. The tracking information may be used to reduce the emissions generated by the vehicle 700 and/or to reduce the amount of fatigue experienced by components of the vehicle 700 (e.g., to provide components of the vehicle 700 with a longer life span).

One example increasing an efficiency of a trip of a vehicle 700 includes analyzing the tracking information to determine the regions within a trip where the EMS 704 was allowed for use but the EMS 704 was nevertheless not used. The trip plan of the EMS 704 for a particular trip can be revised according to the tracking information. Specifically, the tracking information can be utilized to better utilize the EMS 704 and thereby improve the trip plan to provide the propulsion subsystem 706 of the vehicle 700 with an increased efficiency (e.g., a reduce fuel consumption) over the length of the trip plan. The increased efficiency may result in lower operating costs of the vehicle 700, less emissions generated by the vehicle 700, and/or less fatigue of components of the vehicle 700 (e.g., to provide components of the vehicle 700 with a longer life span). When applied over a relatively large number of vehicles within a relatively large transportation network, efficiency gains may significantly reduce the cost of operating the vehicles within the transportation network. Moreover, and for example, the tracking information can be used to alter the orientation, structure, path, and/or the like of one or more routes, for example in regions where the EMS 704 is not used often or at all (whether or not use of the EMS 704 is allowed in such regions). For example, the tracking information can be utilized to change the orientation, structure, path, and/or the like of one or more routes such that a vehicle operator is more likely to use the EMS 704 within the region, which may increase an efficiency (e.g., reduce fuel consumption) of the vehicle 700.

Another example of increasing an efficiency of the transportation network 102 includes using the tracking information to allot the duties of vehicle operators or other workers within the transportation network 102. For example, the tracking information may indicate that a particular operator performs better (e.g., is more efficient, such as, but not limited to, reduce fuel consumption, reduce emissions, and/or the like) on particular types of and/or specific routes within the transportation network 102 as compared with other types and/or specific routes within the network 102. The tracking information can thus be used to allot to the operator the specific and/or types of routes on which the operator performs best. The allotment of routes to a plurality of various operators can thus be improved to provide the transportation network 102 with an increased efficiency.

In one embodiment, a method (e.g., a method for monitoring use of an energy management system (EMS)) includes determining whether use of an energy management system (EMS) associated with a vehicle traveling in a transportation network is allowed within a region of the transportation network. The EMS obtains a trip plan for the vehicle that designates operational settings of the vehicle as a function of at least one of distance or time along a trip of the vehicle. The method also includes determining whether the EMS is being used by the vehicle when the vehicle is within the region, and sending a message to an off-board location when the EMS is not being used by the vehicle within the region.

In another aspect, sending a message to the off-board location includes indicating to the off-board location a reason why the EMS is not being used by the vehicle within the region.

In another aspect, determining whether use of the EMS is allowed within the region includes determining a location of the vehicle within the transportation network and within the region.

In another aspect, determining whether use of the EMS is allowed within the region includes comparing a location of the vehicle within the transportation network to a route chart of the EMS to determine whether the region is an energy management region.

In another aspect, determining whether the EMS is being used by the vehicle includes determining whether an operator is following at least one command instruction within a predetermined threshold during.

In another aspect, determining whether the EMS is being used by the vehicle includes determining whether the trip plan of the EMS is being followed by the vehicle when the vehicle is within the region.

In another aspect, sending the message to the, the location of the vehicle being includes waiting a predetermined amount of time after the vehicle has entered the region to send the message.

In another aspect, the method includes displaying to an operator of the vehicle that the EMS is allowed for use but is not being used when the vehicle is within the region.

In another aspect, the method includes prompting an operator of the vehicle to initiate use of the EMS when the EMS is allowed for use and the vehicle is within the region.

In another aspect, sending the message to the off-board location includes indicating to the off-board location that the EMS is allowed for use within the region.

In another aspect, sending the message to the off-board location includes indicating to the off-board location that the EMS is not being used by the vehicle within the region because of ambient conditions within the region.

In another aspect, sending the message to the off-board location includes indicating to the off-board location that the EMS is not being used by the vehicle within the region because of a configuration issue with the EMS.

In another aspect, the method includes enabling an operator of the vehicle to select a reason why the EMS is not being used within the region, wherein sending the message to the off-board location includes indicating to the off-board location that the EMS is not being used by the vehicle within the region because of the reason selected by the operator.

In another aspect, the trip plan designates the operational settings for the vehicle in order to reduce at least one of fuel consumed or emissions generated during the trip relative to traveling according to another plan.

In another embodiment, a method (e.g., a method for monitoring use of an energy management system (EMS)) includes receiving a message at an off-board location. The message indicates that an energy management system (EMS) associated with a vehicle traveling along a trip within a transportation network is not being used by the vehicle when the vehicle is within a region of the transportation network. The EMS uses a trip plan of operational settings for the vehicle. The method also includes tracking, at the off-board location, use of the EMS by the vehicle as the vehicle travels along the trip within the transportation network.

In another aspect, the message received at the off-board location further indicates that the EMS is allowed to be used within the region.

In another aspect, receiving the message at the off-board location includes receiving the message from the vehicle.

In another aspect, receiving the message includes receiving at least one message for each of a plurality of trips of the vehicle.

In another aspect, receiving the message includes receiving at least one message for at least one trip of each of a plurality of vehicles.

In another aspect, tracking the use of the EMS includes tracking use of the EMS for a plurality of trips of the vehicle.

In another aspect, tracking the use of the EMS includes tracking use of the EMS for at least one trip of each of a plurality of vehicles.

In another aspect, the method includes evaluating an operator of the vehicle based on tracking of the use of the EMS.

In another aspect, the method includes allotting duties of vehicle operators based on tracking of the use of the EMS.

In another aspect, the method includes revising the trip plan of the vehicle based on tracking of the use of the EMS.

In another embodiment, a system (e.g., a system including a control unit, an energy management system (EMS), and/or an off-board location) includes an energy management system (EMS) associated with a vehicle that is configured to travel in a transportation network. The EMS is configured to use a trip plan of operational settings for the vehicle. The system also includes a control unit for the vehicle. The control unit is configured to control operation of the vehicle and is operatively connected to the EMS. The control unit is configured to determine whether the EMS is available for use by the vehicle, determine whether the EMS is being used by the vehicle, and store information obtained from the determination of whether the EMS is being used by the vehicle.

In another aspect, the control unit is configured to determine whether the EMS is available for use by the vehicle by determining whether the EMS is on-line.

In another aspect, the control unit is configured to determine whether the EMS is being used by the vehicle by determining whether a trip plan of the EMS is being followed by the vehicle.

In another aspect, the control unit is configured to determine whether the EMS is being used by the vehicle by determining whether an operator of the vehicle is following at least one control command within a predetermined threshold.

In another aspect, the control unit is configured to store information by storing whether the EMS was available for use by the vehicle at at least one of at least one specific time or within at least one time period.

In another aspect, the control unit is configured to store information by storing whether the EMS was being used by the vehicle at at least one of at least one specific time or within at least one time period when the EMS was available for use by the vehicle.

In another aspect, the control unit is configured to store information on-board the vehicle.

In another embodiment, a method (e.g., a method for monitoring use of an energy management system (EMS)) includes determining whether an energy management system (EMS) associated with a vehicle traveling in a transportation network is available for use by the vehicle. The EMS obtains a trip plan for the vehicle that designates operational settings of the vehicle as a function of at least one of distance or time along a trip of the vehicle. The method also includes determining whether the EMS is being used by the vehicle, and storing information obtained from the determination of whether the EMS is being used by the vehicle.

In another aspect, determining whether the EMS is available for use by the vehicle includes determining whether the EMS is on-line.

In another aspect, determining whether the EMS is available for use by the vehicle includes determining whether use of the EMS is allowed within a region of the transportation network.

In another aspect, determining whether the EMS is being used by the vehicle includes determining whether a trip plan of the EMS is being followed by the vehicle.

In another aspect, determining whether the EMS is being used by the vehicle includes determining whether an operator of the vehicle is following at least one control command within a predetermined threshold.

In another aspect, determining whether the EMS is being used by the vehicle includes determining whether the EMS is being used by the vehicle within a region of the transportation network within which use of the EMS is allowed.

In another aspect, storing information includes storing whether the EMS was available for use by the vehicle at at least one of at least one specific time or within at least one time period.

In another aspect, storing information includes storing whether the EMS was being used by the vehicle at at least one of at least one specific time or within at least one time period when the EMS was available for use by the vehicle.

In another aspect, storing information includes storing whether the EMS was being used by the vehicle when the vehicle was within at least one region of the transportation network wherein use of the EMS was allowed.

In another aspect, storing information includes storing the information on-board the vehicle.

In another aspect, the method further includes sending a message to an off-board location when the EMS is available for use but is not being used by the vehicle.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, including the best mode, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A method comprising:

determining whether use of an energy management system (EMS) associated with a vehicle traveling in a transportation network is allowed within a region of the transportation network, wherein the EMS obtains a trip plan for the vehicle that designates operational settings of the vehicle as a function of at least one of distance or time along a trip of the vehicle, and wherein the trip plan designates the operational settings for the vehicle in order to reduce at least one of fuel consumed or emissions generated during the trip relative to traveling according to another plan;

determining whether the EMS is being used by the vehicle when the vehicle is within the region using a computer; and sending a message to an off-board location when the EMS is not being used by the vehicle within the region using the computer.

2. The method of claim 1, wherein sending the message to the off-board location comprises indicating to the off-board location a reason why the EMS is not being used by the vehicle within the region.

3. The method of claim 1, wherein determining whether use of the EMS is allowed within the region comprises determining a location of the vehicle within the transportation network and within the region.

4. The method of claim 1, wherein determining whether use of the EMS is allowed within the region comprises comparing a location of the vehicle within the transportation network to a route chart of the EMS to determine whether the region is an energy management region.

5. The method of claim 1, wherein determining whether the EMS is being used by the vehicle comprises determining whether an operator is following at least one command instruction within a predetermined threshold.

6. The method of claim 1, wherein determining whether the EMS is being used by the vehicle comprises determining whether the trip plan of the EMS is being followed by the vehicle when the vehicle is within the region.

7. The method of claim 1, wherein sending the message to the off-board location comprises waiting a predetermined amount of time after the vehicle has entered the region to send the message.

8. The method of claim 1, further comprising displaying to an operator of the vehicle that the EMS is allowed for use but is not being used when the vehicle is within the region.

9. The method of claim 1, further comprising prompting an operator of the vehicle to initiate use of the EMS when the EMS is allowed for use and the vehicle is within the region.

10. The method of claim 1, wherein sending the message to the off-board location comprises indicating to the off-board location that the EMS is allowed for use within the region.

11. The method of claim 1, wherein sending the message to the off-board location comprises indicating to the off-board location that the EMS is not being used by the vehicle within the region because of ambient conditions within the region.

12. The method of claim 1, wherein sending the message to the off-board location comprises indicating to the off-board location that the EMS is not being used by the vehicle within the region because of a configuration issue with the EMS.

13. The method of claim 1, further comprising enabling an operator of the vehicle to select a reason why the EMS is not being used within the region, wherein sending the message to the off-board location comprises indicating to the off-board location that the EMS is not being used by the vehicle within the region because of the reason selected by the operator.

14. A method comprising:

receiving a message at an off-board location using a computer, the message indicating that an energy management system (EMS) associated with a vehicle traveling along a trip within a transportation network is not being used by the vehicle when the vehicle is within a region of the transportation network, wherein the EMS uses a trip plan of operational settings for the vehicle, and wherein the trip plan designates the operational settings for the vehicle in order to reduce at least one of fuel consumed or emissions generated during the trip relative to traveling according to another plan; and tracking, at the off-board location, use of the EMS by the vehicle as the vehicle travels along the trip within the transportation network using the computer.

15. The method of claim 14, wherein the message received at the off-board location further indicates that the EMS is allowed to be used within the region.

16. The method of claim 14, wherein receiving the message at the off-board location comprises receiving the message from the vehicle.

17. The method of claim 14, wherein receiving the message comprises receiving at least one message for each of a plurality of trips of the vehicle.

18. The method of claim 14, wherein receiving the message comprises receiving at least one message for at least one trip of each of a plurality of vehicles.

19. The method of claim 14, wherein tracking the use of the EMS comprises tracking use of the EMS for a plurality of trips of the vehicle.

20. The method of claim 14, wherein tracking the use of the EMS comprises tracking use of the EMS for at least one trip of each of a plurality of vehicles.

21. The method of claim 14, further comprising evaluating an operator of the vehicle based on tracking of the use of the EMS.

22. The method of claim 14, further comprising allotting duties of vehicle operators based on tracking of the use of the EMS.

23. The method of claim 14, further comprising revising the trip plan of the vehicle based on tracking of the use of the EMS.

24. A system comprising:

an energy management system (EMS) associated with a vehicle that is configured to travel in a transportation network, the EMS being configured to use a trip plan of operational settings for the vehicle, wherein the trip plan designates the operational settings for the vehicle in order to reduce at least one of fuel consumed or emissions generated during the trip relative to traveling according to another plan; and a control unit for the vehicle, the control unit being configured to control operation of the vehicle and being operatively connected to the EMS, wherein the control unit is configured to:

determine whether the EMS is available for use by the vehicle;

determine whether the EMS is being used by the vehicle; and store information obtained from the determination of whether the EMS is being used by the vehicle.

25. The system of claim 24, wherein the control unit is configured to determine whether the EMS is available for use by the vehicle by determining whether the EMS is on-line.

26. The system of claim 24, wherein the control unit is configured to determine whether the EMS is being used by the vehicle by determining whether a trip plan of the EMS is being followed by the vehicle.

27. The system of claim 24, wherein the control unit is configured to determine whether the EMS is being used by the vehicle by determining whether an operator of the vehicle is following at least one control command within a predetermined threshold.

28. The system of claim 24, wherein the control unit is configured to store information by storing whether the EMS was available for use by the vehicle at at least one of at least one specific time or within at least one time period.

29. The system of claim 24, wherein the control unit is configured to store information by storing whether the EMS was being used by the vehicle at at least one of at least one specific time or within at least one time period when the EMS was available for use by the vehicle.

30. The system of claim 24, wherein the control unit is configured to store information on-board the vehicle.

31. A method comprising:

determining whether an energy management system (EMS) associated with a vehicle traveling in a transportation network is available for use by the vehicle, wherein the EMS obtains a trip plan for the vehicle that designates operational settings of the vehicle as a function of at least one of distance or time along a trip of the vehicle, and wherein the trip plan designates the operational settings for the vehicle in order to reduce at least one of fuel consumed or emissions generated during the trip relative to traveling according to another plan;

determining whether the EMS is being used by the vehicle using a computer; and storing information obtained from the determination of whether the EMS is being used by the vehicle using a memory.

32. The method of claim 31, wherein determining whether the EMS is available for use by the vehicle comprises determining whether the EMS is on-line.

33. The method of claim 31, wherein determining whether the EMS is available for use by the vehicle comprises determining whether use of the EMS is allowed within a region of the transportation network.

34. The method of claim 31, wherein determining whether the EMS is being used by the vehicle comprises determining whether a trip plan of the EMS is being followed by the vehicle.

35. The method of claim 31, wherein determining whether the EMS is being used by the vehicle comprises determining whether an operator of the vehicle is following at least one control command within a predetermined threshold.

36. The method of claim 31, wherein determining whether the EMS is being used by the vehicle comprises determining whether the EMS is being used by the vehicle within a region of the transportation network within which use of the EMS is allowed.

37. The method of claim 31, wherein storing information comprises storing whether the EMS was available for use by the vehicle at at least one of at least one specific time or within at least one time period.

38. The method of claim 31, wherein storing information comprises storing whether the EMS was being used by the vehicle at at least one of at least one specific time or within at least one time period when the EMS was available for use by the vehicle.

39. The method of claim 31, wherein storing information comprises storing whether the EMS was being used by the vehicle when the vehicle was within at least one region of the transportation network wherein use of the EMS was allowed.

40. The method of claim 31, wherein storing information comprises storing the information on-board the vehicle.

41. The method of claim 31, further comprising sending a message to an off-board location when the EMS is available for use but is not being used by the vehicle.

* * * * *